US008151870B2

(12) United States Patent
Woodson

(10) Patent No.: US 8,151,870 B2
(45) Date of Patent: Apr. 10, 2012

(54) TUBE SHIELD ASSEMBLY AND METHOD OF SECURING SAME

(75) Inventor: Damon E. Woodson, Macon, GA (US)

(73) Assignee: The Southern Company, Atlanta, GA (US)

( * ) Notice: Subject to any disclaimer, the term of this patent is extended or adjusted under 35 U.S.C. 154(b) by 910 days.

(21) Appl. No.: 11/939,989

(22) Filed: Nov. 14, 2007

(65) Prior Publication Data

US 2008/0110602 A1 May 15, 2008

Related U.S. Application Data

(60) Provisional application No. 60/865,731, filed on Nov. 14, 2006.

(51) Int. Cl.
*F28F 19/00* (2006.01)
*F16L 57/00* (2006.01)

(52) U.S. Cl. ..... 165/134.1; 138/110; 122/DIG. 13

(58) Field of Classification Search ..... 165/134.1; 138/110; 122/511
See application file for complete search history.

(56) References Cited

U.S. PATENT DOCUMENTS

| | | | | | |
|---|---|---|---|---|---|
| 1,942,211 | A | * | 1/1934 | Hartwig | 165/134.1 |
| 2,646,818 | A | | 7/1953 | Bimpson | |
| 2,859,947 | A | | 11/1958 | Persson | |
| 3,324,533 | A | | 6/1967 | Watteau | |
| 3,741,252 | A | * | 6/1973 | Williams | 138/110 |
| 5,154,648 | A | * | 10/1992 | Buckshaw | 165/134.1 |
| 5,220,957 | A | | 6/1993 | Hance | |
| 5,474,123 | A | * | 12/1995 | Buckshaw | 165/134.1 |
| 5,511,609 | A | | 4/1996 | Tyler | |
| 6,612,366 | B1 | | 9/2003 | Chuang | |

* cited by examiner

*Primary Examiner* — Allen J. Flanigan
*Assistant Examiner* — Jason Thompson
(74) *Attorney, Agent, or Firm* — Dustin B. Weeks, Esq.; Ryan A. Schneider, Esq.; Troutman Sanders LLP

(57) ABSTRACT

A tube shield assembly for protecting tubes includes a guard, a securing member and a holding tooth, wherein welding is not required to secure the guard to the tube. The guard is axially elongated and can have a semi-cylindrical cross-section to define a main body portion. The securing member includes at least one pair of fastening clips to secure the guard to the tube. The fastening clips permit radial expansion and contraction of the tube and the tube shield assembly in response to, for example, temperature fluctuations. The holding tooth is a tooth-like protrusion between the tube shield assembly and the tube to which it is secured to prevent axial slippage of the tube shield assembly up or down the length of the tube.

16 Claims, 10 Drawing Sheets

TUBE SHIELD ASSEMBLY AND METHOD OF SECURING SAME

CROSS REFERENCE TO RELATED APPLICATION

This application claims benefit, under 35 U.S.C. §119(e), of U.S. Provisional Application Ser. No. 60/865,731, filed 14 Nov. 2006, the entire contents and substance of which is hereby incorporated by reference.

BACKGROUND

1. Field of the Invention

The present invention relates to protection devices, and more particularly to conduit shields used to protect conduits in various heat-exchanger apparatuses, such as boilers and condensers. The present invention is further related to boiler tube shields for protecting tubes from the hostile environment in a boiler, for example, from corrosive or abrasive soot or fly ash in a fossil fuel boiler.

2. Description of Related Art

Conduits are hollow, elongated casings for which liquid, gas and the like can flow therethrough. Conduits, such as tubes and pipes, are often used in various heat exchanger apparatuses, for example, boilers and condensers for heating a medium, such as water. Unfortunately, tubes employed in a boiler, particularly a fossil fuel boiler, are typically exposed to hostile elements, such as soot, fly ash, extreme heat, soot blower steam, or combinations thereof. The hostile elements will eventually take their toll on the tubes via corrosion or abrasion of the exterior wall, such that the wall of one or more tubes may over time lose its integrity and eventually fail, resulting in major maintenance and significant boiler downtime costs.

Conduit shields, often referred to as tube shields, were designed to protect the boiler conduits from the harsh environment within the boiler. Specifically, the conduit shield protects a portion of the exterior wall of the tube of the conduit.

For instance, conventional tube shields are axially-elongated protector members having a cross-section that is sized to fit over a tube to protect the integrity of the tube from the boiler environment. Most boiler tube shield designs require that the shield be welded to the tube that it protects. But the welding process can be unsafe, time-consuming, expensive, and require specialized tools and training. In addition, welding is a permanent attachment process that requires great effort to reverse should the tube shield require adjustment or removal.

Referring to FIGS. 1-3, a conventional, exemplary system of heating water in a boiler environment 100 is illustrated. Water flows through the conduit, or tube, 105. In the boiler environment 100, it is desired that the water be heated, so heated boiler gas 110 is forced past the tube 105 to heat the water in the tube 105.

Typically, the boiler gas 110 contains particulates 115. Oftentimes, the particulates 115 come from combustion boxes of the boiler environment 100. Soot or ash, which is essentially matter that will not burn, is an exemplary particulate in the boiler gas 110 in the boiler environment 100. The heated boiler gas 110 containing particulates 115 is forced by the tube 105 and causes the ash particulate 115 to move at a high velocity. As a result, the particulates 115 can strike the tube and/or adhere thereto, which over time erodes the wall 105*w* of the tube 105. When ash and other particulates accumulate on the outside wall 105*w* of the tube 105, as shown in FIG. 3, high pressure steam can be used to clean same. Unfortunately, high pressure steam can also include particulates (e.g., water particulate), which can also damage the wall 105*w* of the tube 105.

Thus, in order to protect the tube 105, a shield 200 has conventionally been attached to the outside wall 105*w* of the tube 105. A perspective view of a conventional shield 200 is illustrated in FIG. 4. Conventional shields 200 include a body 205 for protecting the tube 105, and a band 210 for securing the body 205 to the tube 105. Conventional shields 200 are welded to the tube 105 in the path of the particulates by the band 210. Weld points 215 are the connection between the band 210 and the body 205. FIG. 5 illustrates the conventional shield 200 secured to the tube 105.

Unfortunately, the weld points 215 are typically the first to erode because they are in the direction of the gas flow, for example see Arrow A of FIG. 5. Ultimately over time, the weld points 215 fail because the particulates 115 strike the weld point, and hence it becomes compromised. As a result, the weld fails and the shield 200 falls off the tube. Further, because conventional shields 200 are solely held in place by the welded band, there is a likelihood that over time the shield 200 will shift either axially (along the length of the tube) or rotationally (around the tube).

Therefore, what is needed is an improved tube shield assembly overcoming the deficiencies of the prior art. It is to such a device that the present invention is primarily directed.

SUMMARY OF THE INVENTION

Briefly described, in preferred form, the present invention is an improved conduit shield assembly for protecting conduits. Preferably, the conduit shield assembly is a tube shield assembly for protecting tubes, for example in a boiler environment. The tube shield assembly does not require welding to be secured to the tube. In addition, a tooth-like protrusion (e.g., a holding tooth) between the tube shield assembly and the tube to which it is secured prevents axial slippage (i.e., up or down the length of the tube) of the tube shield assembly.

The tube shield assembly includes a guard, a holding tooth, and at least one pair of securing members. The guard is axially elongated and can have an approximate semi-cylindrical cross-section to define a main body portion. The cross section of the guard can be more or less than 180 degrees, as preferably a surface of the tube in which flow would contact is covered. The main body portion can include axially extending free edges, as well as semi-cylindrical edges. Further, the main body portion of the guard is shaped having a radius approximately sized to the radius of the shielded tube for cooperatively mating to an exterior of the tube to be protected. Other shapes can be utilized as appropriate, for example and not limitation, channel-shaped or U-shaped. Preferably, the holding tooth is positioned in an interior portion of the main body portion, such that it is protected from the hostile elements. The holding tooth is adapted to bitingly engage the tube for securing the boiler tube shield to the tube. The securing member, preferably a fastening clip member, includes predrilled mating holes for accepting a fastener, such as a bolt and nut assembly, a pin, or a screw. The fastening clip members extend from opposing axially free edges such that when the fastening clip members are bent around the tube, the holes can be mated with the fastener. In an exemplary embodiment, tightening the fastening clip members can cause the holding tooth to further bitingly engage the tube, and hence reduce axial slippage of the tube shield assembly about the tube.

In a preferred embodiment, the securing member is fastened around the tube and outside the direction of gas flow, which can extend the life of the tube shield assembly and protect the securing member from particulates flowing in the gas.

Exemplary beneficial features of the tube shield assembly of the present invention include: the tube shield assembly does not require welding, is simple to install, prevents slippage or axial movement along the tube (i.e., up or down the length of the tube) once it is placed in service, and extends the life of the tube and tube shield assembly.

These and other objects, features and advantages of the present invention will become more apparent upon reading the following specification in conjunction with the accompanying drawing figures.

DETAILED DESCRIPTION OF PREFERRED EMBODIMENTS

Figure 1:
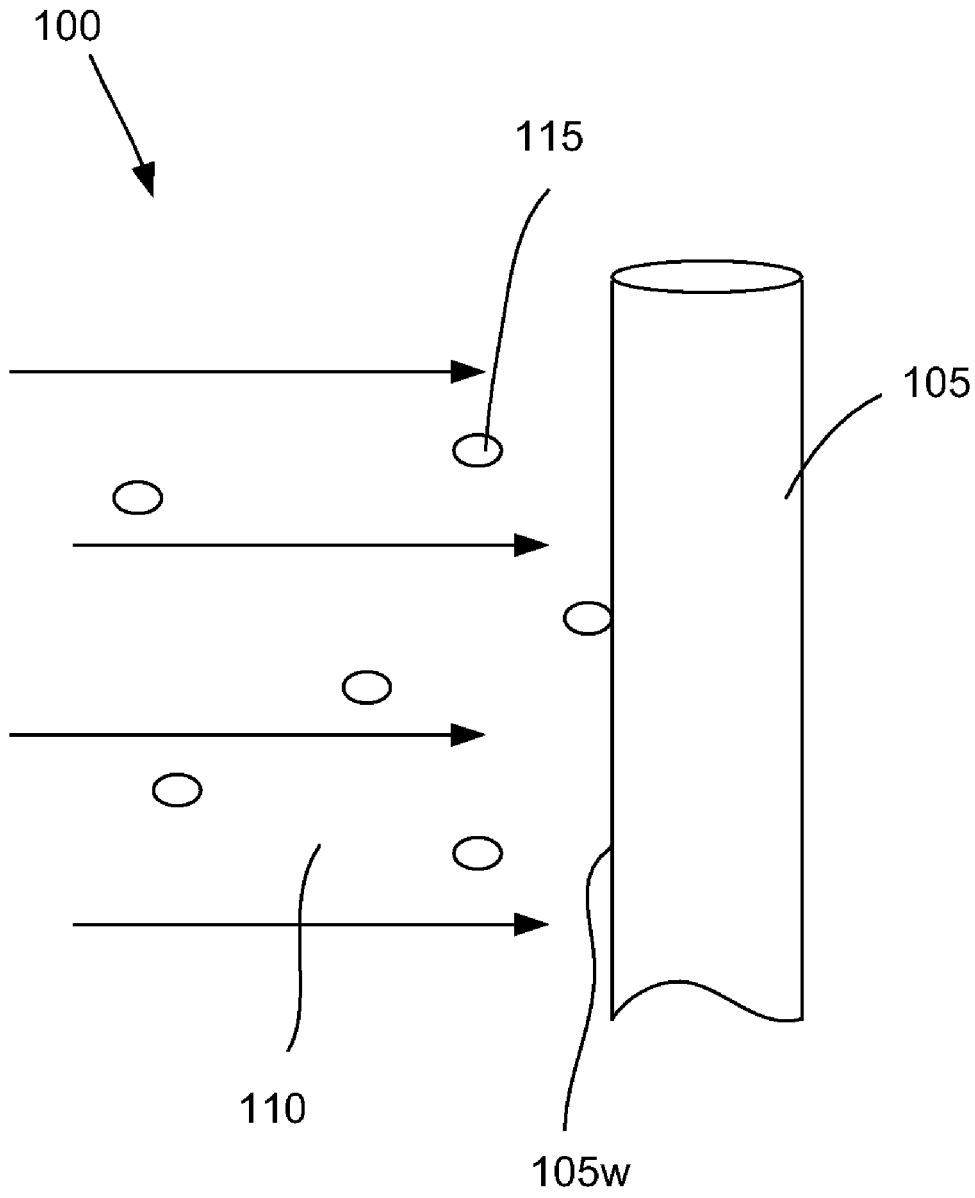
Fig. 1 Prior Art
FIG. 1 is a perspective view of a conventional boiler system for heating media in a tube.
Figure 2:
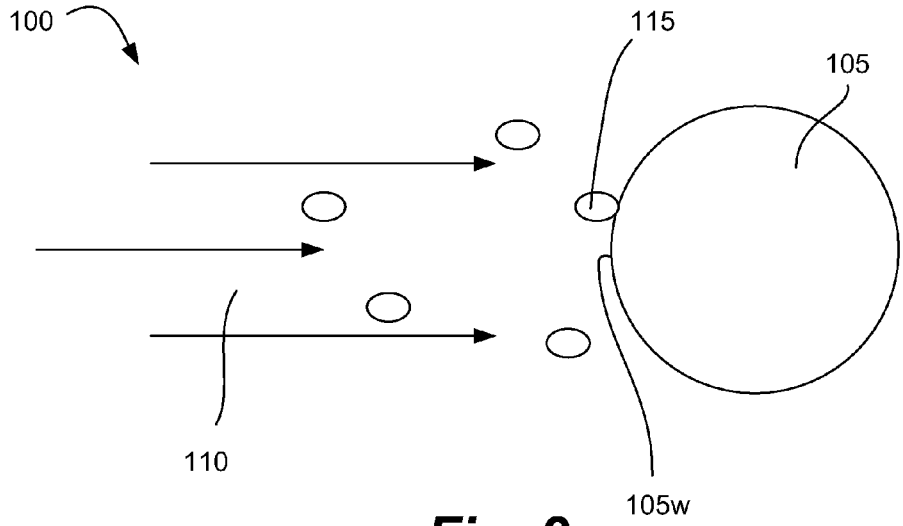
Fig. 2 Prior Art
FIGS. 2-3 are top views of the conventional boiler system for heating media in the tube.

To facilitate an understanding of the principles and features of the invention, it is explained hereinafter with reference to its implementation in an illustrative embodiment. In particular, the invention is described in the context of being a tube shield assembly for protecting tubes from the hostile environment in a boiler, for example, from corrosive or abrasive soot or fly ash in a fossil fuel boiler.

The invention, however, is not limited to its use as a tube shield assembly for protecting tubes. Rather, the invention can be used when a protection device for protecting an exterior wall of a conduit is desired or necessary. Thus, the device described hereinafter as a tube shield assembly can also find utility as a device for other applications, beyond that of boiler tube environment.

The material described hereinafter as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring now to the figures, wherein like reference numerals represent like parts throughout the view, the present invention will be described in detail. The present invention comprises a conduit tube assembly.

The present invention is a conduit shield assembly 500 for protecting an exterior wall of conduits. More preferably, the conduit shield assembly 500 comprises a tube shield assembly 600 for protecting tubes, for example, tubes 105 inside a boiler, such as a fossil fuel boiler (not depicted), from the high-temperature, corrosive, and abrasive environment that exists therein. Specifically, the tube shield assembly 600 protects the exterior side wall 105*w* of the tube 105. The tube shield assembly 600 of the present invention protects the tubes 105 from particulates 115, for example, fly ash or soot, thus extending the life of the tubes 105. As one skilled in the art would appreciate, other conduits that need exterior wall protection can be protected with the present invention, for example and not limitation, tubes, pipes, and the like.

The tube shield assembly 600 can protect a portion of the exterior side wall 105*w* of the tube 105, or the whole circumference of the tube 105.

Figure 6A:
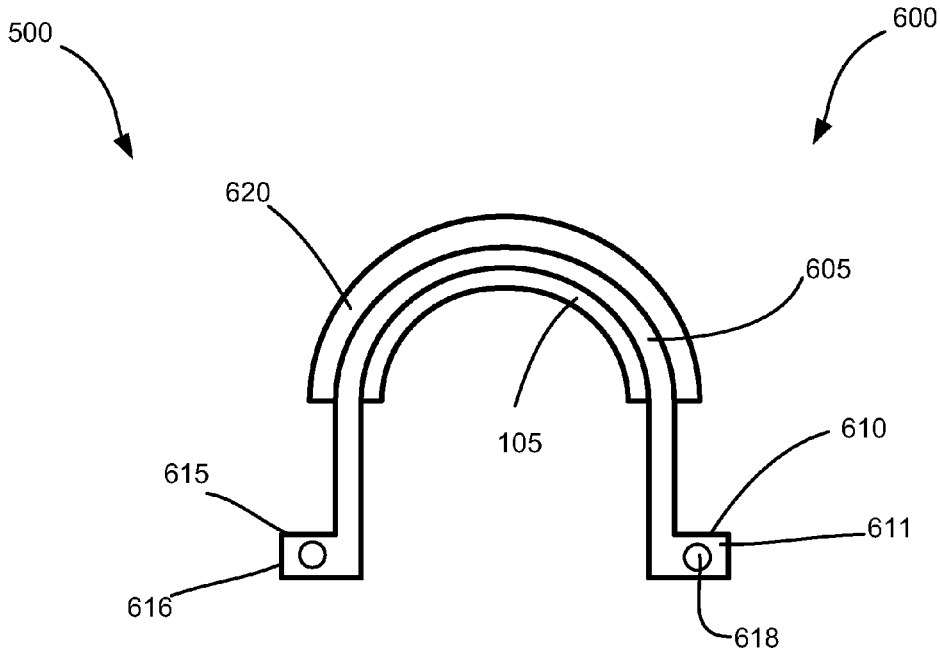
FIGS. 6A-6B are cross-sectional views of a tube shield assembly, in accordance with an exemplary embodiment of the present invention.
Figure 6B:
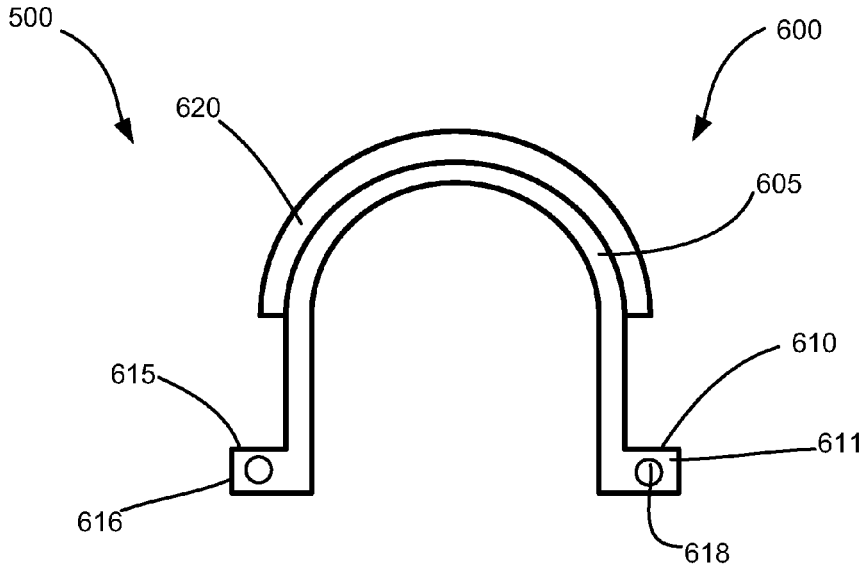

FIG. 6A illustrates a top cross-sectional view of the tube shield assembly 600 before the tube shield assembly 600 is fastened onto the tube 105. The tube shield assembly 600 includes a shield body 605, i.e., guard, at least one set of securing members 610 and 615, and a holding tooth 630 (see FIGS. 6C and 8). The shield body 605 is adapted to protect the tube 105 from particulates. The shield body 605 is essentially a guard that protects a surface of the tube 105 that would generally be in the flow. Preferably, the shield body 605 includes a flow surface (e.g., outer surface) for protecting the tube 105, and an inner portion that can include the holding tooth 630. The securing members 610 and 615 are adapted to secure the shield body 605 to the tube 105. Preferably, the securing members 610 and 615 can be fastened to one another. The holding tooth 630 is adapted to engage the tube 105 when the securing members are secured. In one embodiment, the holding tooth 630 can bitingly engage the tube 105 for further securing the shield body to the tube 105. As shown in FIGS. 6A-6B, a beneficial feature of the present invention can include an extra layer 620 of the shield body 605 to enhance protection.

The shield body 605 can be axially elongated and can have an approximate semi-cylindrical cross-section to define a main body portion. In another embodiment, the shield body 605 can have an arcuate cross-section. For instance, the cross-section of the shield body 605 can be more or less than 180 degrees, as preferably a surface of the tube in which flow would contact is covered. The main body portion can include axially extending free edges, as well as semi-cylindrical edges. Further, the main body portion of the shield body 605 is shaped having a radius approximately sized to the radius of the shielded tube for cooperatively mating to an exterior of the tube to be protected. Other shapes can be utilized as appropriate, for example and not limitation, channel-shaped or U-shaped.

Preferably, the shield body 605 is in communication with the tube 105. In order for the high/low temperature of the flow to be transferred to the media in the tube 105, it is preferable that the inner portion of the shield body 605 be in contact with the tube 105 for heat transfer. As one skilled in the art would appreciate, a transfer chemical or compound can be positioned between the inner portion of the shield body 605 and the tube 105 for additional heat flow purposes.

Figure 4:
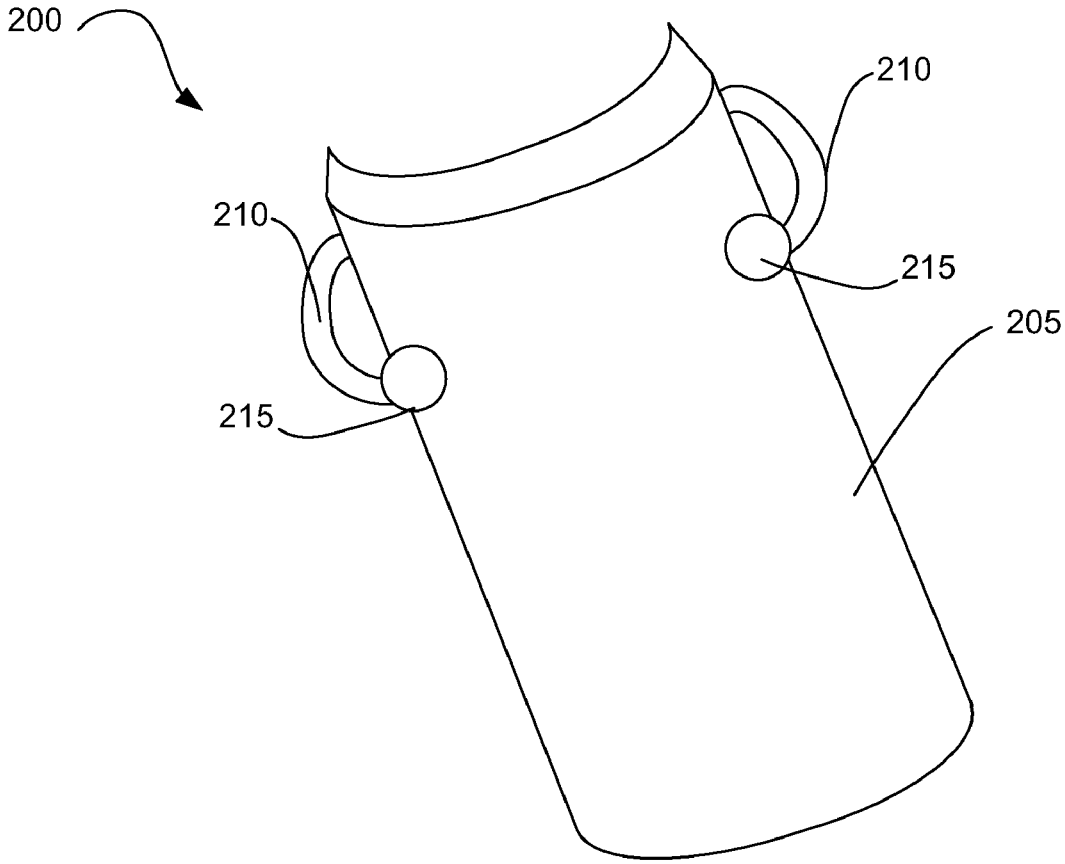
Fig. 4 Prior Art
FIG. 4 is a perspective view of a conventional tube shield.
Figure 5:
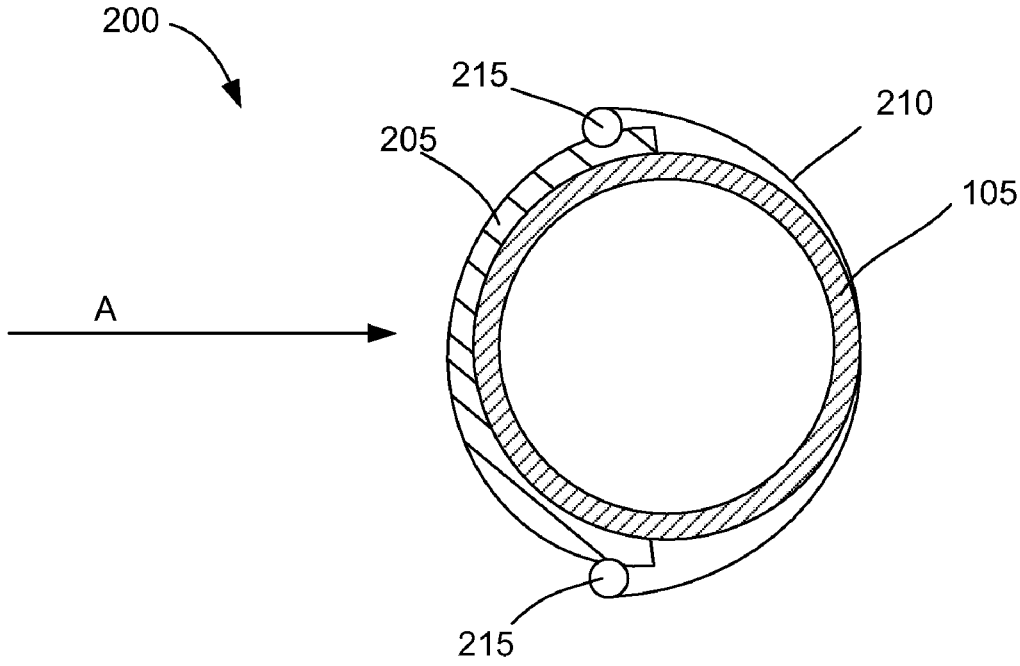
Fig. 5 Prior Art
FIG. 5 is a cross-sectional view of the conventional tube shield welded to the tube.

The flow surface of the shield body 605 is preferably smooth. By being smooth, flow can easily travel around the tube shield assembly 600, and thus the tube 105. In the conventional tube shield (see FIGS. 4-5), the welding point interfered with the flow and thus caused turbulence, or an unstable flow. The tube shield assembly 600 of the present invention, by way of the smooth flow surface of the shield guard 605 and the positioning the securing members 610 and 615 out of the flow, can provide a non-turbulent flow around the tube 105.

The shield body 605 can be constructed of many suitable materials that are capable of withstanding the extreme corrosiveness, abrasiveness, and high temperatures of the environment. Representative materials include, but are not limited to, stainless steel (e.g., 310, 304, or 316 alloys), or carbon steel having a protective overlay (e.g., A-36 carbon steel with Stellite® 22 cobalt-based overlay). Other suitable materials, such as ceramics or composites, are known to those of ordinary skill in the art.

Figure 6C:
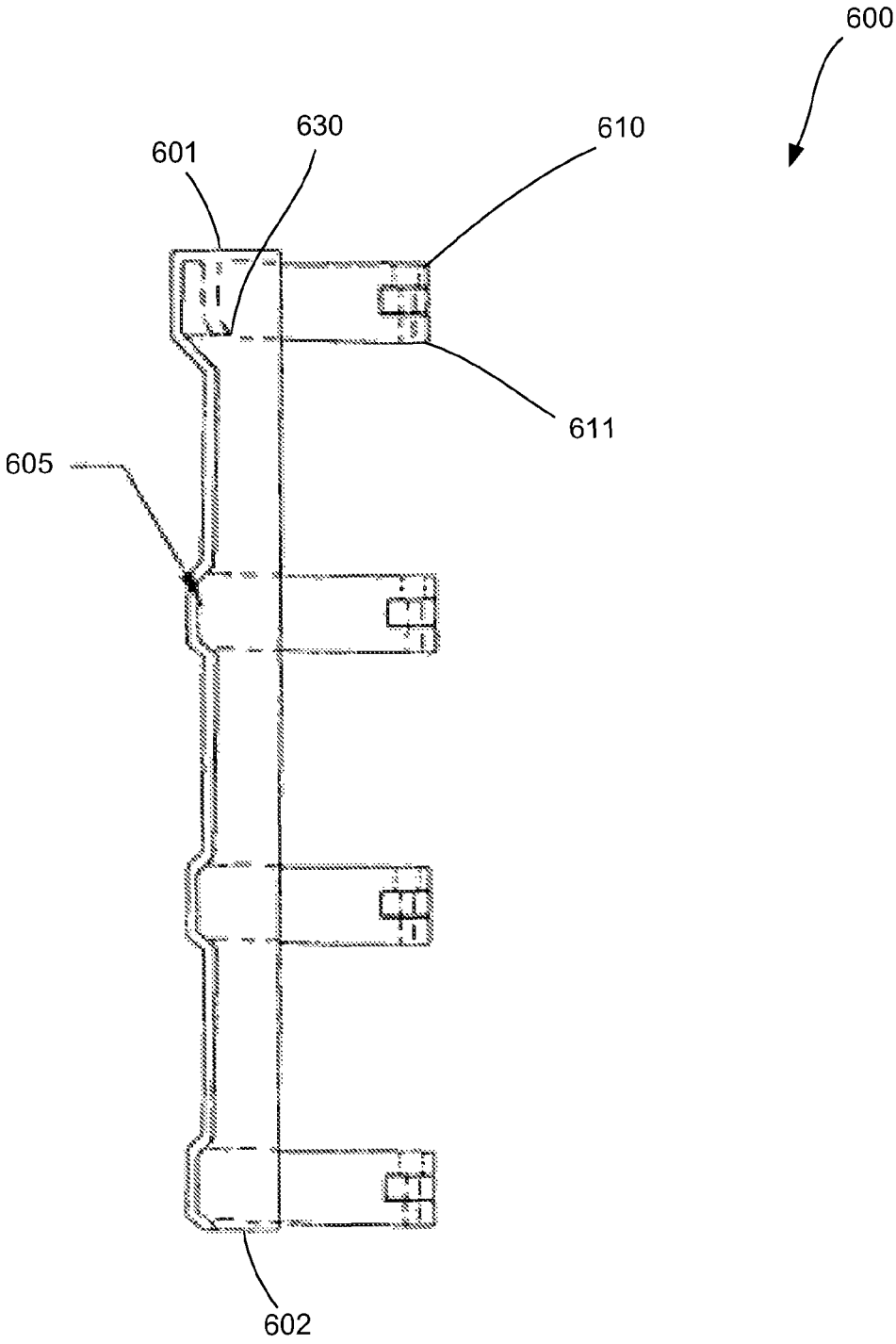
FIGS. 6C-6D are partial, cross-sectional views of the tube shield assembly, in accordance with an exemplary embodiment of the present invention.
Figure 6D:
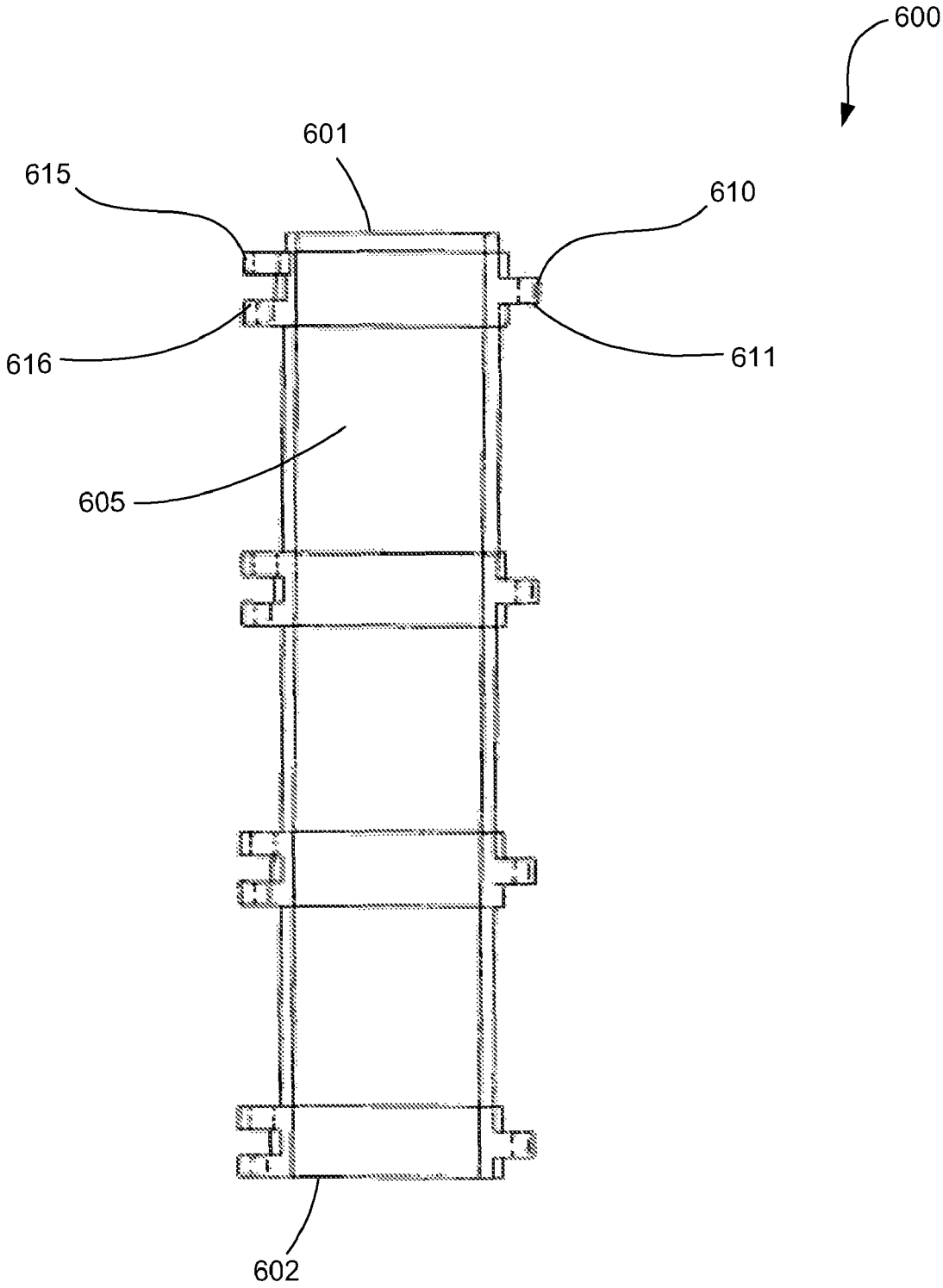

FIG. 6C depicts a partial, cross-sectional side view of the tube shield assembly 600. In particular, FIG. 6C illustrates the shield body 605, the holding tooth 630, and one of the securing members 610. FIG. 6D is a front view of the tube shield assembly 600 as viewed from the front, i.e., the concave portion formed by the shield body 605 as it is to be mounted onto the tube 105; the securing members 610 and 615 are also shown in FIG. 6D.

The securing members 610 and 615 preferably comprise fastening clips 611 and 616. The fastening clips 611 and 616 of the present embodiment can include a first clip 611 and a second clip 616 oppositely situated about the shield body 605. Upon installation, the fastening clips 611 and 616 can be bent (e.g., using pliers, vise grips, and the like) to conform to the contour of the tube that the shield body 605 surrounds, and thus protects.

Figure 7A:
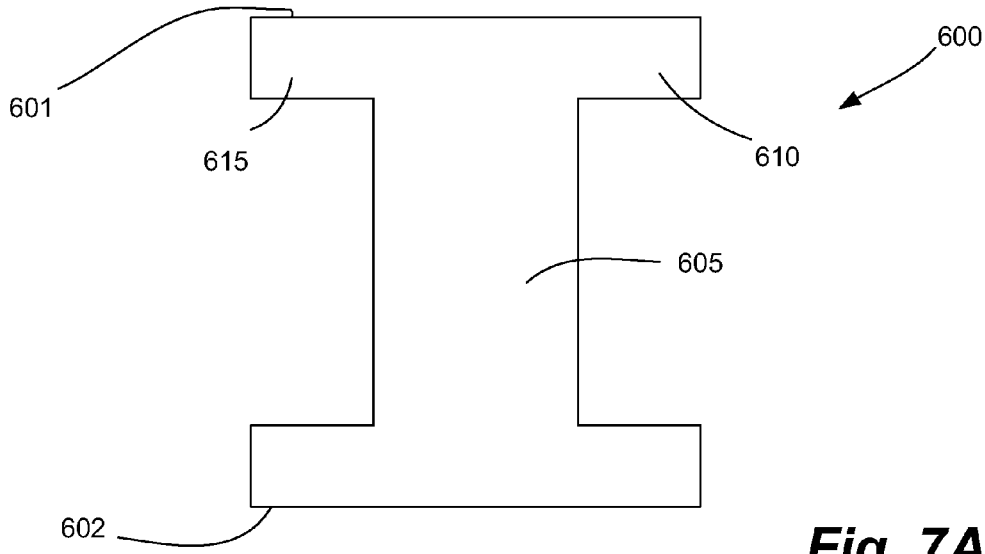
FIGS. 7A-7B are views of the tube shield assembly along with securing members, in accordance with an exemplary embodiment of the present invention.
Figure 7B:
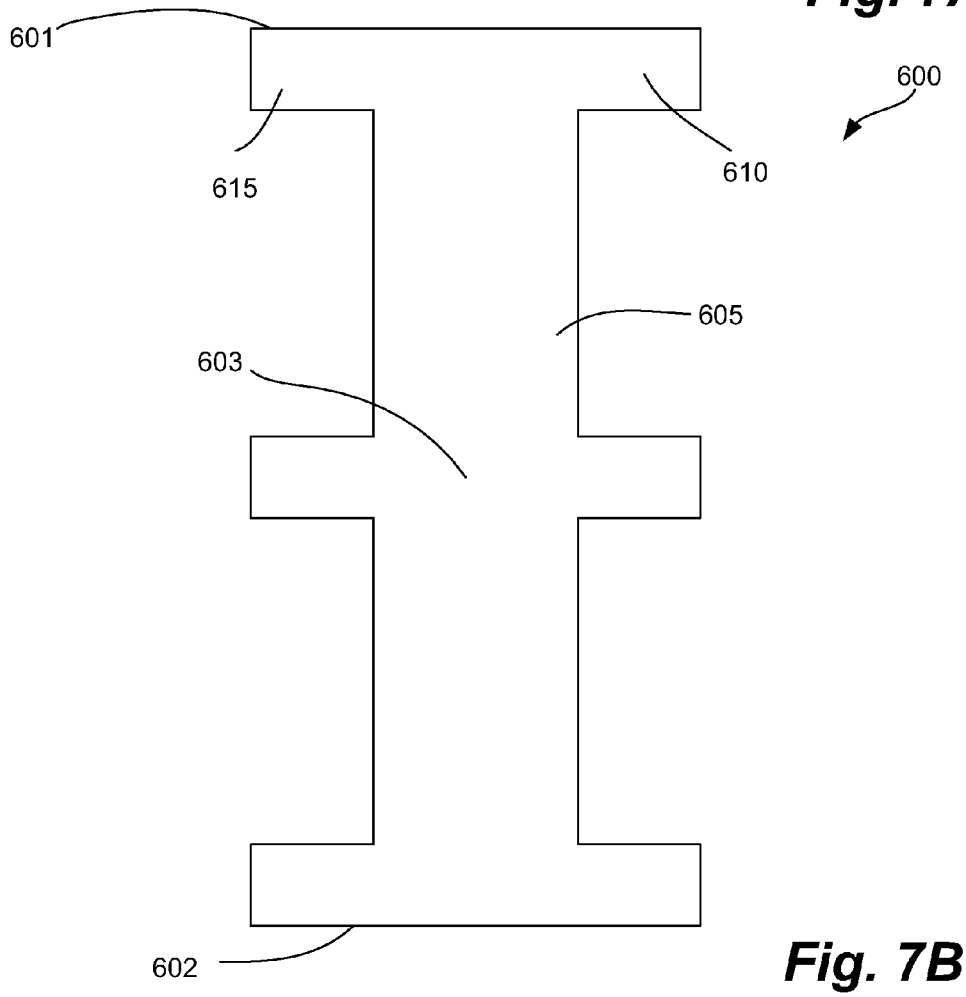

In an exemplary embodiment, the tube shield assembly 600 can be made of unitary construction, i.e., a single piece of material. For instance, as illustrated in FIGS. 7A-7B, the tube shield assembly 600 is of unitary construction. In particular, the shield body 605 can be of unitary construction with the securing members 610 and 615. The tube shield assembly 600 can include at least one pair of securing members 610 and 615. As shown in FIG. 7A, there can be two securing members at the first and second ends 601 and 602 of the shield body 605. As shown in FIG. 7B, there can be three securing members at both the first and second ends 601 and 602 of the shield body 605, as well at approximately the midpoint 603 of the length of the shield body 605. In a preferred embodiment, the securing members can be placed at a distance of less than one foot from other securing members along the shield body's length. Though not depicted in FIGS. 7A-7B, the tube shield assembly 600 can also be of unitary construction with the holding tooth 630; hence, all the elements of the tube shield assembly 600 can be of unitary construction. Of course, as one skilled in the art would appreciate, the tube shield assembly 600 can alternatively be of non-unitary construction, or composed of a number of pieces.

Figure 8:
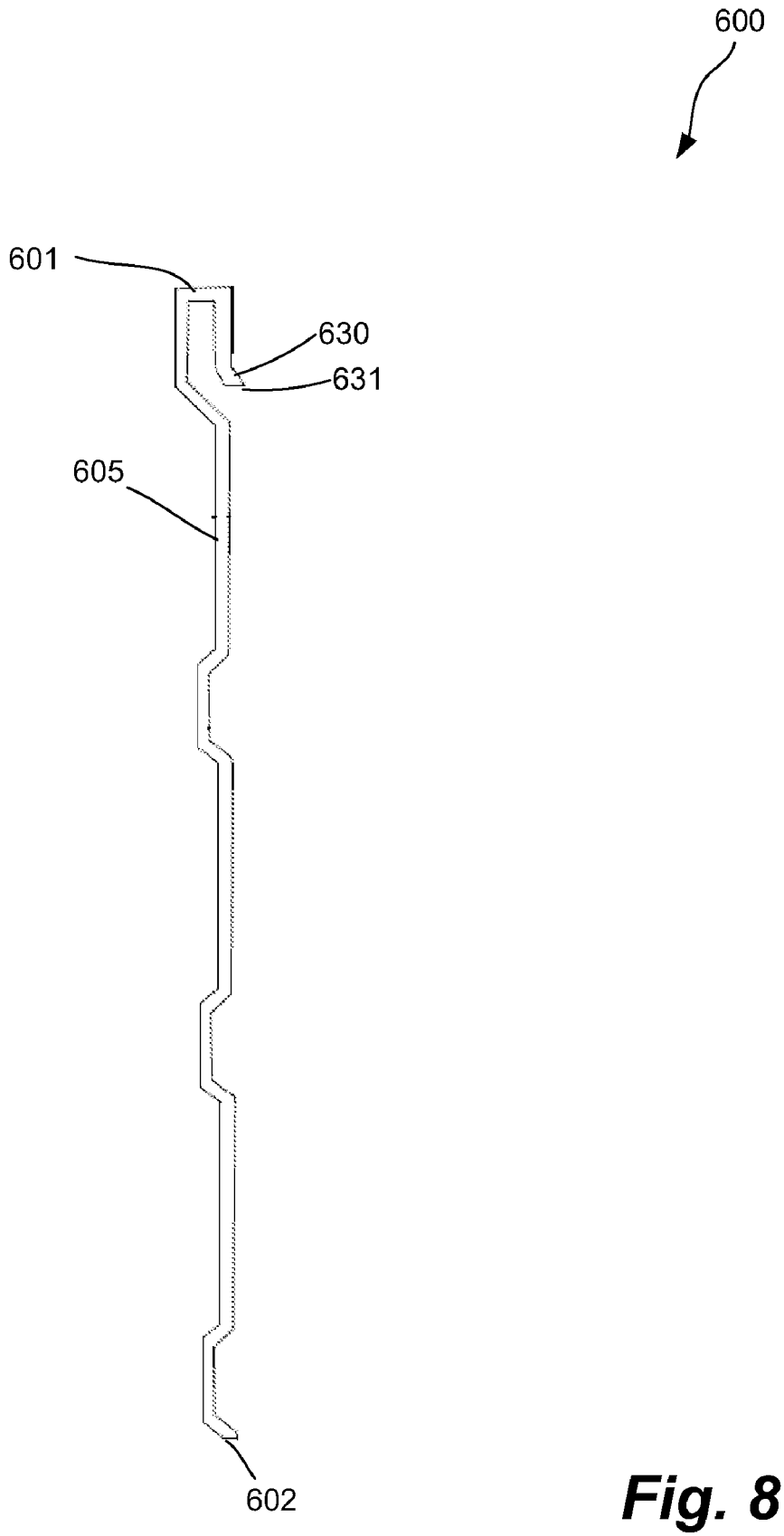
FIG. 8 is an axial, cross-sectional view of the tube shield assembly, in accordance with an exemplary embodiment of the present invention.

FIG. 8 illustrates a cross-sectional side view of a preferred embodiment of the tube shield assembly 600. A holding tooth 630 can be integral to or otherwise made part of the shield body 605. The holding tooth 630 can comprise a pointed end 631, which can serve to "dig" into the wall of the tube 105 to which the tube shield assembly 600 is mounted. A beneficial feature of the holding tooth 630 can further anchor the tube shield assembly 600 to the tube 105. In addition, the holding tooth 630 secures the tube shield assembly 600 to the tube 105 tighter as the fastening clips 611 and 616 are fastened and tightened to reduce or prevent axial movement (i.e., up or down the length of the tube) of the tube shield assembly 600. As one skilled in the art would appreciate, more than one holding tooth 630 can be implemented in the tube shield assembly 600. It is preferable that the holding tooth 630 be positioned at the first end 601, preferably the top end, of the tube shield assembly 600, but the holding tooth 630 can be placed at other positions along the tube shield assembly 600, and additional holding teeth 630 can also be positioned along the tube shield assembly 600 as is needed or desired.

Figure 9A:
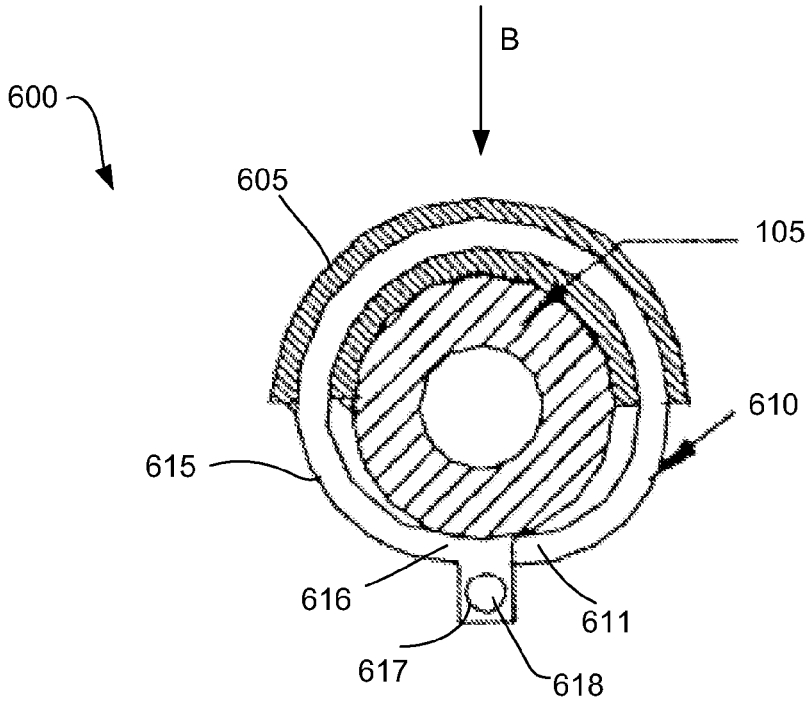
FIGS. 9A-9B are cross-sectional views of the tube shield assembly secured about the tube, in accordance with an exemplary embodiment of the present invention.
Figure 9B:
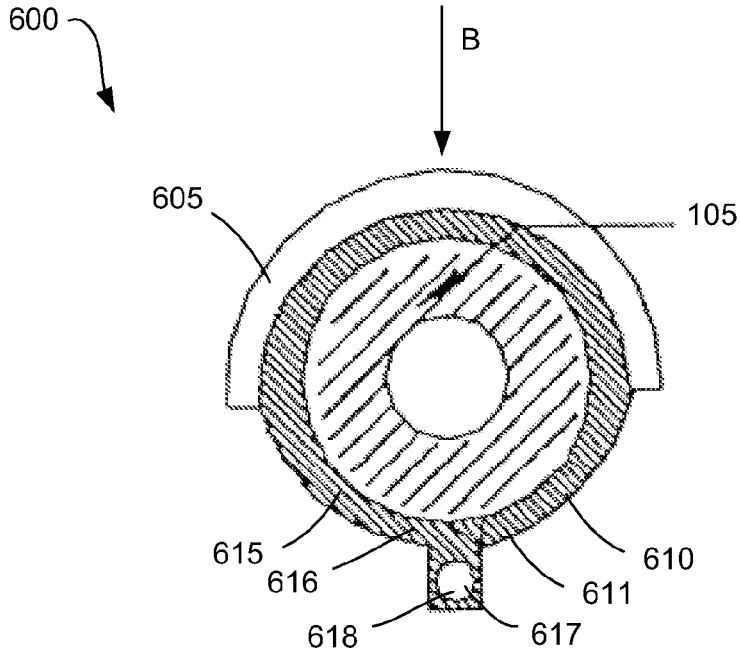

FIGS. 9A-9B illustrate cross-sectional views of preferred embodiments of the present invention with the tube shield assembly 600 being axially mounted in place around a tube 105. As shown in FIG. 9A, the first fastening clip 611 is placed (or bent, if necessary) about the tube 105 to which the tube shield assembly 600 is to be mounted. Next, the second fastening clip 616 (situated opposite the first) is placed (or bent, if necessary) in close proximity to the first fastening clip 611 such that the fastening clips 611 and 616 can be tethered or otherwise connected to secure the tube shield assembly 600 in place. In one embodiment, the fastening clips 611 and 616 both have openings 617 that can be aligned for placement of a fastener 618 therethrough. The fastener 618 can be, for example, a bolt and nut assembly, a pin, a screw, or the like. Other appropriate fasteners are known to those of ordinary skill in the art.

Given the high temperatures that exist about a boiler environment, expansion of the materials (i.e., metal materials) can occur. Another beneficial feature of the present invention utilizes fastening clips 611 and 616 that, by their design, accommodate the radial expansion of the tube 105 to which the tube shield assembly 600 can be mounted as well as the radial expansion of the tube shield assembly material itself. For example, if the fastening clips 611 and 616 are fastened with a pin, at least one of the fastening clips will be capable of rotating about the pin (radially with respect to the tube shield assembly 600 and the tube 105) to accommodate expansion and contraction of the tube. The radial adjustment feature does not compromise the function of the holding tooth 630. Accordingly, the tube shield assembly 600 can adjust radially in response to expansion of the metal tube 105 that it surrounds, and can also adjust to its own expansion without incurring axial movement that might expose the tube to the boiler elements.

Another beneficial feature of the present invention depicted in FIGS. 9A-9B includes the placement of the fastening clips 611 and 616 in contact with the tube 105 upon installation of the tube shield assembly 600. Gas temperatures within a boiler (e.g., a fossil fuel boiler) can easily exceed 1000° F. but the tube 105 temperature may be at or below 1000° F. The materials suited for use in the present invention can withstand 1000° F. temperatures, however, the materials can degrade and weaken significantly if exposed to temperatures approaching or exceeding 2000° F. To this end, the feature of placing the fastening clips 611 and 616 in contact with the relatively cooler tube 105 (as compared with the boiler gas temperature) conducts the lower temperature of the tube to the tube shield assembly 600, including the fastening clips 611 and 616, thus prolonging the life of the assembly.

Figure 3:
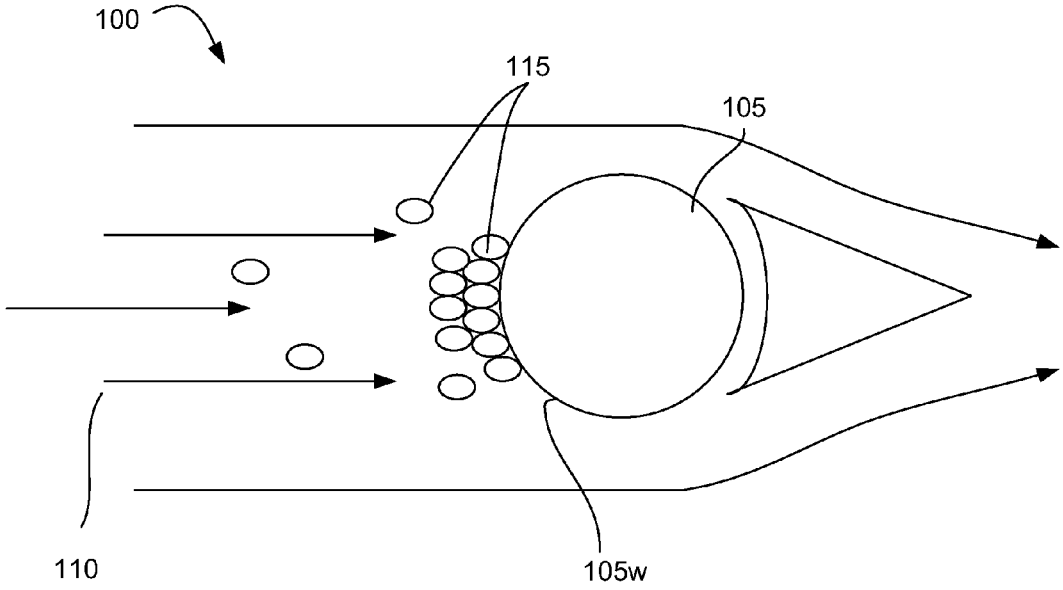
Fig. 3 Prior Art

Because of the placement of the securing members, or specifically the fastening clips 611 and 616, there is no need to weld them together. Thus, yet another beneficial feature of the present invention is depicted in FIGS. 9A-9B includes the placement of the fastening tabs 611 and 616 on the opposite side of the tube 105 as the shield body 605 and, if applicable, extra layers 620 over the shield body 605. Instead of being in the path of gas flow, which can include damaging particulates 115, the fastening clips 611 and 616 are preferably placed out of the way of gas flow 110 (see Arrow B in FIGS. 9A-9B). Referring back to FIG. 3, the fastening clips 611 and 616 are preferably secured to one another in the triangular region 150, i.e., behind the tube 105, which does not receive much, if any, gas flow, because the draft of gas flows around the tube. This design keeps the fastening clips 611 and 616 out of the direct path of the abrasive and corrosive gases and particles in the boiler environment, thus prolonging the life span of the tube shield assembly 600.

Referring now to FIGS. 6C-6D and 8, yet another beneficial feature of the present invention is illustrated with respect to the placement of the fastening clips 611 and 616 about the shield body 605. Incorrect placement (i.e., spacing) of the fastening clips 611 and 616 about the shield body 605 can result in bowing of the tube 105 as the temperature of the tube 105 and the tube shield assembly 600 increases and the material expands. This is especially true if the tube 105 and the tube shield assembly 600 materials have different heat expansion rates. To alleviate this problem, one embodiment of the present invention utilizes fastening clips 611 and 616 at fixed intervals, thus making it unlikely for an installer to space the clips incorrectly and cause bowing of the tube 105. The intervals between the fastening clips 611 and 616 can be different depending on the tube 105 and tube shield assembly 600 construction materials. Appropriate fastening clip spacing can be calculated or estimated by one of ordinary skill in the art. By way of example, the intervals between the fastening clips can be between approximately 2 and approximately 24 inches apart, or between approximately 6 and approximately 18 inches apart, or approximately 12 inches apart.

In an exemplary embodiment, the tube shield assembly 600 can comprise a two-piece shield body design. The two-piece shield design can incorporate a plurality of fastening clips to fasten around a tube in the same manner as described above.

In yet another embodiment, the invention is a tube shield assembly 600 including a layered metal shield body 605 adapted to fit over a tube 105, further including at least one set of fastening clips 611 and 616, and an integral holding tooth 630 such that fastening the fastening clips 611 and 616 engages the holding tooth 630 against the tube 105. In this manner, the holding tooth 630 can minimize or prevent axial movement of the tube shield assembly 600. The layered metal shield body 605 can include layers of the same or different materials.

The fastening clips 611 and 616 are preferably situated opposite one another and can have openings 617 that align upon bending the clips into position. The openings 617 can accept a fastener 618 (e.g., a bolt and nut assembly, a pin, or a screw) to secure the clips 611 and 616 in place. Typically, the fastening clips 611 and 616 are mounted such that they are on the opposite side of the tube 105 as the abrasive or corrosive elements to which the tube is exposed. In this manner, the shield body 605 is the only element of the tube shield assembly 600 exposed to the harsh elements and protects the tube from those elements.

Whereas the above-described embodiments have been described in detail with the accompanying figures, it will be understood that various changes from these embodiments can be made without departing from the scope or spirit of the invention, which is set forth in the following claims.

What is claimed is:

1. A tube shield for protecting a tube in a flow, the tube shield comprising:

a guard having a flow surface in communication with the flow, the flow surface protecting the tube and providing non-turbulent flow around the tube;

a securing member comprising a first end and a second end, the first end extending from a first free edge of the guard, the second end extending from an opposing second free edge of the guard, wherein the first end is positioned directly opposite the second end, the securing member securing the guard to the tube; and a holding tooth integral with the guard, wherein the holding tooth and the guard are of unitary construction, the holding tooth bitingly engaging the tube.

2. The tube shield of claim 1, the guard comprising an arcuate cross-section and having an axial, elongated shape.

3. The tube shield of claim 1, the securing member being positioned outside the flow.

4. A tube shield assembly for protecting a tube in a flow, the tube shield assembly comprising:

a guard having a flow surface in communication with the flow, the flow surface protecting the tube and providing non-turbulent flow around the tube; and a securing member comprising a first end and a second end, the first end extending from a first free edge of the guard, the second end extending from an opposing second free edge of the guard, wherein the first end is positioned directly opposite the second end, the securing member securing the guard to the tube, the securing member further comprising at least one set of fastening clips about the guard, the at least one set of fastening clips comprising:

a first clip; and a second clip oppositely situated to the first clip, wherein the first clip and the second clip align and fasten to each other to engage a holding tooth, the holding tooth integral with the guard, wherein the holding tooth and the guard are of unitary construction, wherein the holding tooth is bitingly engaged against a tube to hold the guard in place.

5. The tube shield assembly of claim 4, the first and second clips fasten together using a fastener.

6. The tube shield assembly of claim 5, the first and second clips aligned and fastened to one another in contact with the tube.

7. The tube shield assembly of claim 4, the fastening clips radially adjustable for accommodating the expansion or contraction of the tube.

8. The tube shield of claim 1, the tube shield being of unitary construction.

9. The tube shield of claim 1, wherein an inner portion of the guard is in contact with tube enabling the transfer of heat from the flow to the tube for heating media in the tube.

10. A tube shield assembly for protecting a tube in a boiler environment, the tube shield assembly comprising:

a layered metal shield body fitted around a portion of the tube;

at least one securing member comprising a first end and a second end, the first end extending from a first free edge of the shield body, the second end extending from an opposing second free edge of the shield body, wherein the first end is directly opposite the second end, the securing member further comprising a set of fastening clips for securing the body about the tube; and a holding tooth integral with the body, wherein the body and the holding tooth are of unitary construction, the holding tooth bitingly engaging the tube to further secure the body about the tube, the holding tooth engaging a portion of an exterior side wall of the tube.

11. The tube shield assembly of claim 10, the holding tooth preventing axial movement of the shield body about the tube.

12. The tube shield assembly of claim 10, the layered metal shield body comprising an arcuate shape to conform to the shape of the tube having a cylindrical shape.

13. A non-welding method of securing a shield assembly to a tube in boiler system for protecting the tube, the boiler system comprising a boiler gas forced around the tube for heating media contained in the tube, the method comprising:

providing a shield comprising an arcuate shape cooperatively fitted around a portion of the tube, the shield protecting the tube from the boiler gas and a plurality of particulates contained in the boiler gas;

engaging a holding tooth with a portion of an exterior wall the tube for securing the shield to the tube and for preventing axial movement of the shield, wherein the holding tooth and the shield are of unitary construction, wherein the holding tooth is bitingly engaged to the portion of the exterior wall of the tube by a securing member, the securing member comprising a first end and a second end, the first end extending from a first free edge of the shield, the second end positioned directly opposite the first end and extending from an opposing second free edge of the shield, the securing member further comprising a pair of fastening clips; and fastening the pair of fastening clips to one another for securing the shield to the tube.

14. The method of claim 13, wherein the fastening clips are fastened to one another outside the flow of boiler gas.

15. The method of claim 13, wherein the fastening clips are fastened to one another outside the flow of particulates in the boiler gas.

16. The method of claim 13, further comprising inserting a fastener into an aperture of the pair of fastening clips for fastening the fastening clips to one another.

* * * * *